US005801580A

United States Patent [19]

Wu

[11] Patent Number: 5,801,580

[45] Date of Patent: Sep. 1, 1998

[54] SELF-BIASED VOLTAGE-REGULATED CURRENT SOURCE

[75] Inventor: Chuan-Yu Wu, Keelung, Taiwan

[73] Assignee: Powerchip Semiconductor Corp., Hsinchu, Taiwan

[21] Appl. No.: 756,792

[22] Filed: Nov. 26, 1996

[51] Int. Cl.[6] ..... G05F 1/10

[52] U.S. Cl. ..... 327/538; 327/541; 327/543

[58] Field of Search ..... 323/315, 316; 327/530, 538, 540, 541, 543

[56] References Cited

U.S. PATENT DOCUMENTS 5,654,665 8/1997 Menon et al. ..... 327/543

*Primary Examiner*—Timothy P. Callahan
*Assistant Examiner*—Jeffrey Zweizig
*Attorney, Agent, or Firm*—Ladas & Parry

[57] ABSTRACT

A self-biased voltage-regulated current source is disclosed. The present invention includes a current source circuit for generating a constant output current; a voltage source for supplying an unstable voltage for the current source circuit; a regulating circuit for generating a regulated voltage coupled to the current source circuit; and a bias circuit, coupled to the regulating circuit, for generating a bias current to the regulating circuit and the current source circuit, where the bias current is greater than the output current of the current source circuit.

5 Claims, 4 Drawing Sheets

SELF-BIASED VOLTAGE-REGULATED CURRENT SOURCE

CROSS REFERENCE TO RELATED APPLICATION

This invention is related to copending U.S. patent application Ser. No. 08/759,783, filed Dec. 3, 1996, "Low-current Source Circuit" assigned to the same assignee as the present application, which application is hereby incorporated herein by reference.

BACKGROUND OF THE INVENTION

1. Field of the Invention

The present invention relates to a current source, and particularly to a self-biased voltage-regulated current source for stabilizing the output current of the current source.

2. Description of the Prior Art

A stable current source is frequently used in an electrical circuit, for example, to bias a transistor, supply a constant current source or a reference voltage. The low current is further needed in fabricating an integrated circuit, where a low power consumption is a prerequisite. However, a long circuit response time caused by the low current consequently degrades the circuit, destablizes or even malfunctions the circuit whenever the value of the output current from the current source fluctuates.

A conventional current source, such as the reference voltage generator used in a voltage down-converter disclosed in IEEE Journal of Solid-State Circuits, VOL. 27, NO. 7, July 1992, entitled "A 34-ns 16-Mb DRAM with Controllable Voltage Down-Converter" by Hideto Hidaka et. al., is depicted in FIG. 1. A node $M_2$ is charged through a p-type metal-oxide-semiconductor (PMOS) transistor $Q_1$, which is powered by a voltage source $V_{CC}$. A gate 10 and a source 12 of the PMOS transistor $Q_1$, is connected in parallel with a resistor 11, whose resistance R is conventionally programmed by a fuse process. Another PMOS transistor $Q_2$ is used for outputting a constant current I. A reference current $I_1$ flowing through an n-type metal-oxide-semiconductor (NMOS) transistor $Q_3$ is further used for determining the constant current I flowing from drain 14 of the PMOS transistor $Q_2$ to drain 16 of a NMOS transistor $Q_4$, and a reference voltage is thus generated at node 18. The amount of the output current I is determined by:

$$I=V_{thp}/R \quad [1]$$

where $V_{thp}$ is the threshold voltage of a MOS transistor and where R is the resistance of the resistor 11.

The potential at node $M_1$ is therefore determined by the following equation:

$$V_{M1}=V_{CC}-V_{thp}$$

The PMOS transistor $Q_2$, which has a high output resistance, acts as a current output stage, and the potential at node $M_2$ is approximated by the following equation if the current I is small enough:

$$V_{M2}=V_{M1}-V_{thp}=V_{CC}-2V_{thp}$$

When the currents I and $I_1$ approach zero, an idle state, also referred to as a shutdown mode, is reached, and the potential at node $M_1$ is:

$V_{M1}=V_{CC}$

The potential at node $M_2$ is:

$$V_{M2}>V_{CC}-V_{thp}$$

As the charging at node $M_2$ is faster than the charging at node $M_1$ due to a fluctuation voltage bump $V_{bump}$, the voltage at node $M_2$ increases above $(V_{CC}-V_{thp})$, forcing the whole circuit into the idle state. This idle state can not be eliminated when the difference voltage between the node $M_1$ and node $M_2$ is less than the threshold voltage of a MOS transistor even the voltage at $M_2$ is less than $(V_{CC}-V_{thp})$. Subsequent charging at node $M_1$ through resistor 11 and discharging at node $M_2$ is needed to recover from the idle state. According to the equation 1, a large resistance R is required s for a low-current source circuit, further lengthening the idle time $t_{off}$ which is proportional to the resistance R.

SUMMARY OF THE INVENTION

According to the present invention, a self-biased voltage-regulated current source is disclosed. The present invention includes a current source circuit for generating a constant output current. A voltage source, which is usually unstable, supplies a voltage for the current source circuit. A regulating circuit, for example serially connected diodes, is used for generating a regulated voltage coupled to the current source circuit, and a bias circuit, for example a current mirror circuit, coupled to the regulating circuit is used for generating a bias current to the regulating circuit and the current source circuit in response to the output current of the current source circuit, where the bias current is greater than the output current of the current source circuit.

DESCRIPTION OF THE PREFERRED EMBODIMENT

Figure 2:
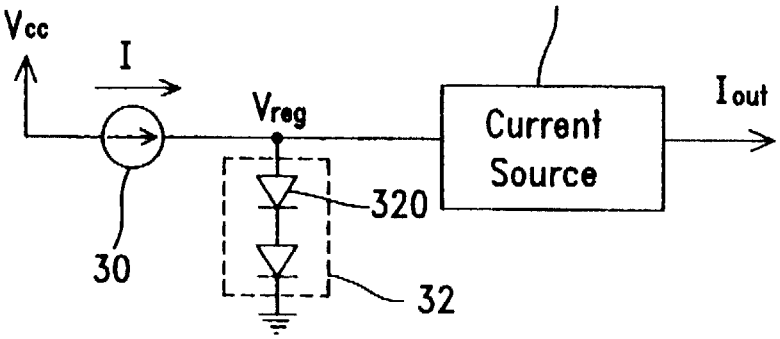
FIG. 2 shows a block diagram of a self-bias voltage-regulated current source according to the present invention.

FIG. 2 shows a block diagram of a self-biased voltage-regulated current source. A bias current I is generated by the bias circuit 30 in response to the output current $I_{out}$ of the current source 34. A bias current I greater than the output current $I_{out}$ is provided by the bias circuit 30. A regulating circuit 32 is used to regulate the voltage $V_{reg}$ inputting to the current source 34 by clamping the regulated voltage $V_{reg}$ through at least one diode 320. Those skilled in the art appreciate that other circuit configurations can be equivalently used instead of simply one or more diodes 320. The bias current I is then fed to the regulating circuit 32 and the current source 34.

Figure 1:
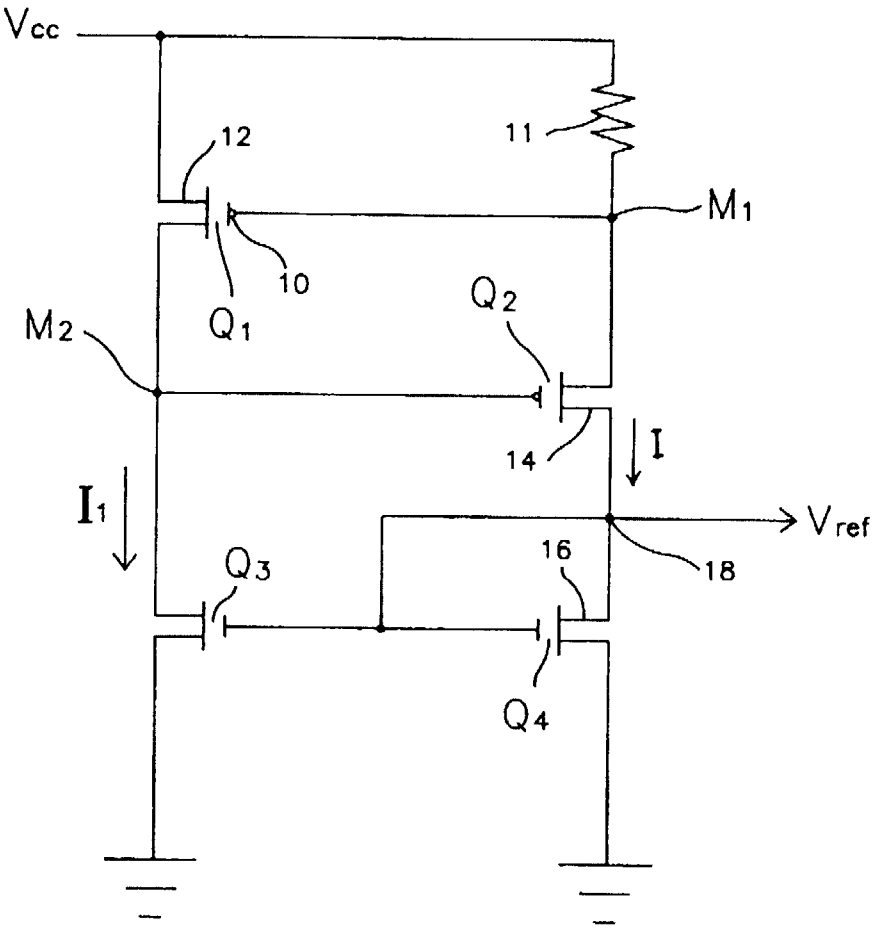
FIG. 1 (Prior Art)
FIG. 1 shows a conventional current source circuit.
Figure 3:
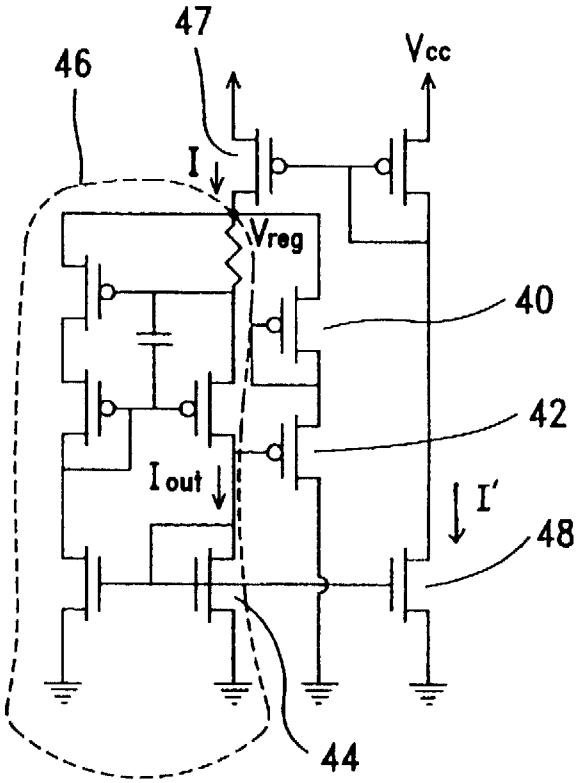
FIG. 3 shows the circuit diagram of one preferred embodiment according to the present invention.

FIG. 3 shows the circuit diagram of one of the preferred embodiments according to the present invention. Two PMOS transistors 40 and 42 and an NMOS transistor 44 provide the regulating circuit 32 schematically shown in FIG. 2 for maintaining the input voltage $V_{reg}$ of the current source 46 equal to the sum of the threshold voltages of these MOS transistors, i.e., $2V_{thp}+V_{thn}$ for this embodiment, where $V_{thp}$ is the threshold voltage of a PMOS transistor, and $V_{thn}$ is the threshold voltage of an NMOS transistor. The transistors in the regulating circuit are connected serially, and each acts like a clamping diode. A bias current I greater than the output current $I_{out}$ is thus produced from a current mirror circuit 46, 47 and 48. This circuit uses $I_{out}$ as the reference current and generates the bias current. The bias current is then fed to the regulating circuit formed by transistors 40, 42 and 44, and to the current source circuit 46.

Figure 4:
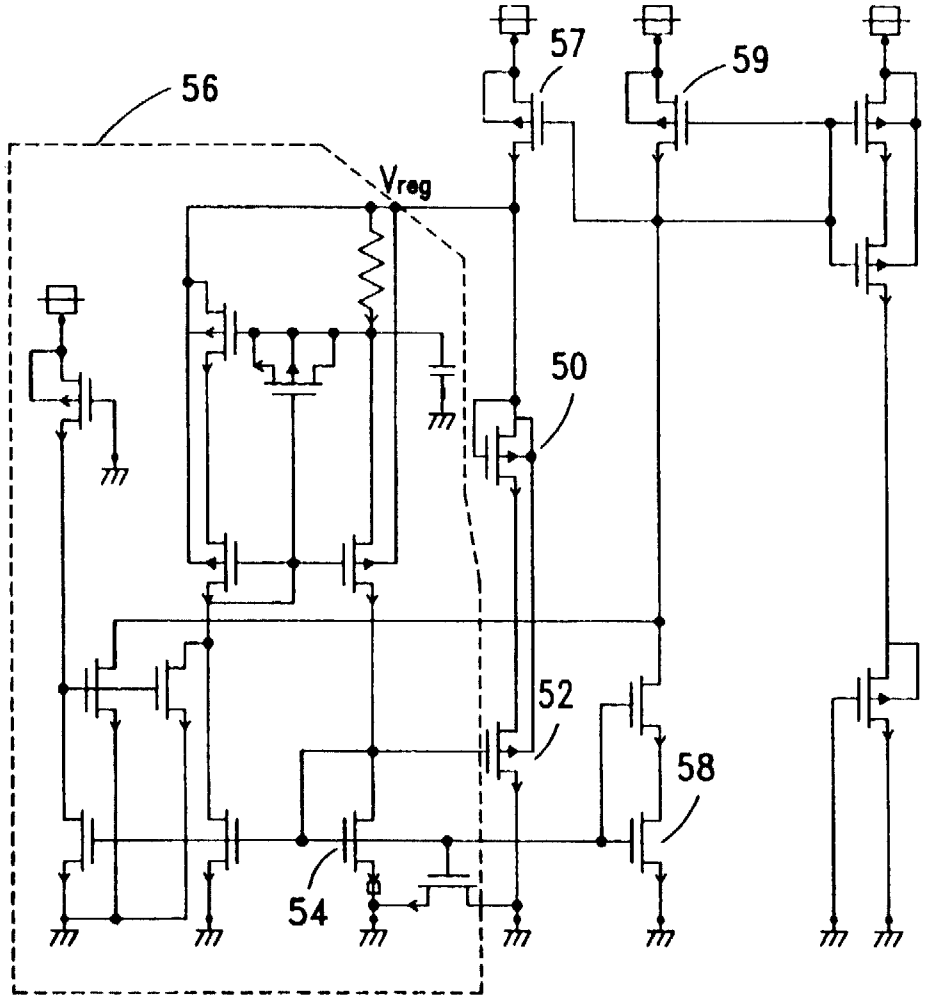
FIG. 4 shows a detailed circuit diagram similar to that of FIG. 4.

FIG. 4 shows a detailed circuit diagram similar to that of FIG. 3. The circuit of FIG. 4 includes a current source circuit 56, whose regulated input voltage $V_{reg}$ is regulated by a regulating circuit formed by transistors 50, 52 and 54, and whose input current is supplied by a bias circuit, which includes transistors 57, 58 and 59.

Figure 5:
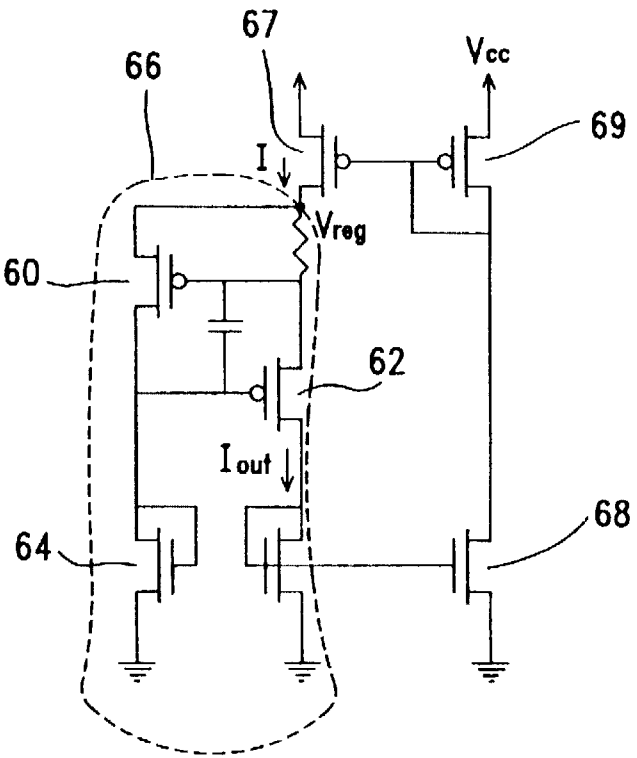
FIG. 5 shows the circuit diagram of another preferred embodiment according to the present invention.

Referring now to FIG. 5, another embodiment is shown where the bias circuit 67, 68 and 69 is the same as those of FIG. 3. Three transistors 60, 62 and 64 provide the regulating path for clamping the input voltage of the source circuit 66 to the regulated voltage $V_{reg}$. It is worth noting that the components of the regulating circuit share transistors 60, 62 and 64 with the current source circuit 66, thereby consuming less current.

Figure 6:
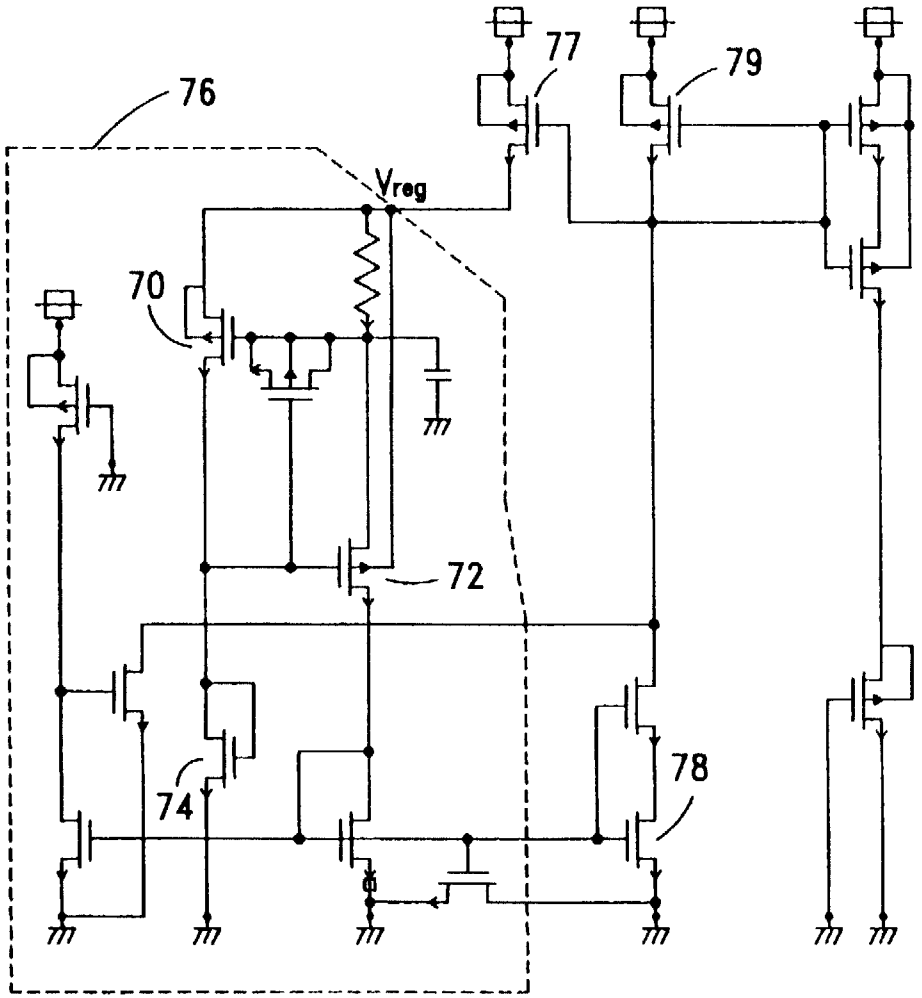
FIG. 6 shows a detailed circuit diagram similar to that of FIG. 6.

FIG. 6 is a detailed circuit diagram similar to that of FIG. 5. The circuit of FIG. 6 includes a current source circuit 76, whose regulated input voltage $V_{reg}$ is regulated by a regulating circuit formed by transistors 70, 72 and 74, and whose input current is supplied by a bias circuit, which includes transistor 77, 78 and 79.

Figure 7:
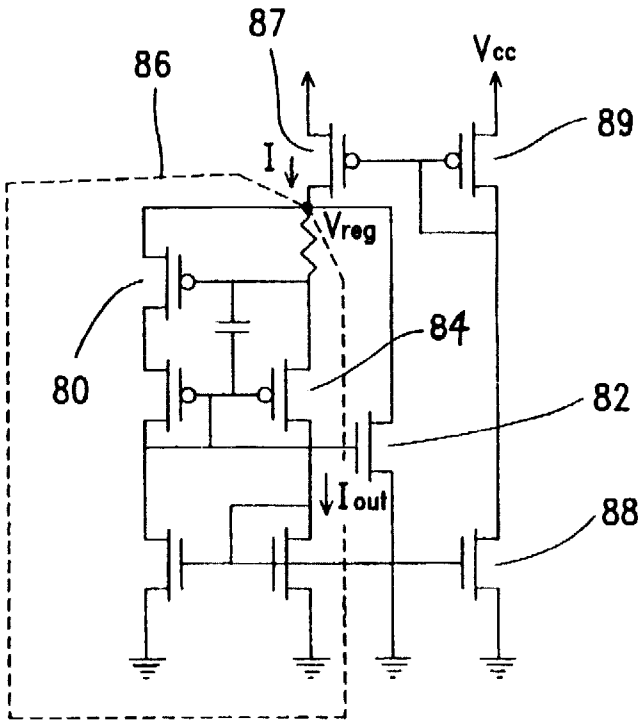
FIG. 7 shows the circuit diagram of another preferred embodiment according to the present invention.

FIG. 7 further shows another embodiment according to the present invention. The current mirror circuit formed by transistors 87, 88 and 89 are the same as those of FIG. 3 and FIG. 5. Here transistors 80, 82 and 84 provide the regulating path for clamping the input voltage of the current source circuit 86 to the regulated voltage $V_{reg}$.

Although specific embodiments have been illustrated and described it will be obvious to those skilled in the art that various modification may be made without departing from the spirit which is intended to be limited solely by the appended claims.

What is claimed is:

1. A self-biased voltage-regulated current source comprising:

a current source circuit for generating a constant output current;

a voltage source for supplying a voltage for said current source circuit, the potential of said voltage source fluctuating;

regulating means for generating a regulated voltage, said regulating means being coupled to said current source circuit; and bias means, coupled to said regulating means, for generating a bias current to said regulating means and said current source circuit in response to the constant output current of said current source circuit, said bias current being greater than the output current of said current source circuit.

2. The self-biased voltage-regulated current source according to claim 1, wherein said bias means comprises current mirror means for generating the bias current to said regulating means and said current source circuit.

3. The self-biased voltage-regulated current source according to claim 1, wherein said regulating means comprises at least one diode device for clamping potential of an input of said current source circuit to the regulated voltage.

4. The self-biased voltage-regulated current source according to claim 3, wherein said diode device comprises a transistor.

5. The self-biased voltage-regulated current source according to claim 4, wherein said diodes devices are connected in serial such that the regulated voltage is clamped to sum of threshold voltages of said transistors.

* * * * *